United States Patent [19]

Yaros

[11] 4,051,681

[45] Oct. 4, 1977

[54] UNITARY ROOF BOLT ASSEMBLY

[76] Inventor: Lee William Yaros, 136 Gedney Road, Trenton, N.J. 08638

[21] Appl. No.: 619,739

[22] Filed: Oct. 6, 1975

[51] Int. Cl.[2] ..... E21D 20/02

[52] U.S. Cl. ..... 61/45 B

[58] Field of Search ..... 61/45 B; 85/1 R; 52/698, 744

[56] References Cited

U.S. PATENT DOCUMENTS

| | | | |
|---|---|---|---|
| 3,702,060 | 11/1972 | Cumming | 61/45 B |
| 3,913,733 | 10/1975 | Flesch et al. | 61/45 B X |

FOREIGN PATENT DOCUMENTS

| | | | |
|---|---|---|---|
| 1,268,624 | 6/1961 | France | 61/45 B |

*Primary Examiner*—Paul R. Gilliam
*Assistant Examiner*—David H. Corbin
*Attorney, Agent, or Firm*—Gersten Sadowsky; Donald A. Gardiner

[57] ABSTRACT

A unitary roof bolt assembly which obviates the necessity for a two or more component system. The assembly includes a standard elongated roof bolt which is desired to be adhesively secured within a bore hole of a rock-like roof structure or the like. A flexible bag or sack contains a conventional quick-setting adhesive resin and hardening material and is circumflexed about the elongated stem of the roof bolt so as to surround and encompass same. Securing means are provided for maintaining the flexible sack and bolt as a unitary structure prior to insertion of the assembly into the bore hole, whereafter the flexible sack is ruptured upon rotation of the bolt and upon contact with the innermost wall of the bore hole to release the adhesive.

In a preferred embodiment, the flexible bag comprises a long thin tubular sack, having a diameter on the order of the diameter of the elongated stem of the roof bolt, and is wrapped about the stem of the bolt in a close packed spiral fashion. A reduced diameter spiral sack extends from the distal end of the bolt so as to be rupturable upon contact with the innermost wall of the bore hole.

7 Claims, 4 Drawing Figures

UNITARY ROOF BOLT ASSEMBLY

BACKGROUND OF THE INVENTION

1. Field of the Invention

The present invention is related to roof bolting assemblies designed to strengthen the roofs of mines and, more particularly, is directed toward a single-component, unitary roof bolt assembly which offers ease of storage, handling, and operation heretofore unrealizable.

2. Description of the Prior Art

Several designs of anchor bolts have been utilized for strengthening roofs in subterranian structures, such as coal mines, subway tunnels, and the like.

One of the more popular and widely accepted designs utilizes a standard rod or bolt which is secured within a drill or bore hole by means of an adhesive or grouting material. The advent of quick-setting adhesive resins has in fact popularized a two-component roof bolt assembly which consists of a destructible cartridge or capsule that contains the quick-setting resin and a hardening agent. The cartridge or capsule is first inserted into a drilled bore hole, whereafter the bolt is inserted, the cartridge is ruptured, and the bolt is held in place until the adhesive sets.

The foregoing technique is exemplified in U.S. Pat. Nos. 3,877,235; 3,703,790; 3,298,144; 3,302,410; and 2,092,341.

Each of the structures described in the cited patents unfortunately suffers from several disadvantages and inconveniences. In particular, the roof bolting assemblies described therein are comprised of at least two, and sometimes three, dis-united components in the form of the adhesive-containing cartridge or capsule, the roof bolt which is eventually adhesively bonded within the bore hole, and a means for rupturing the capsule or cartridge to release the quick-setting resin about the roof bolt.

Such multiple component assemblies require the installer of the roof bolt to match on-site a particular sized bolt with the separately provided capsule or cartridge in order to provide the most efficient combination for the particular bore hole being reinforced. Further, the separate components require more time and attention for installation than might be necessary if they were unitary, a multi-component assembly sometimes requiring two people for proper installation and setting. Additionally, the individual capsules or resin-containing cartridges must be separately stored from their respective roof bolts, which requires excess storage space and multiple inventory problems than might otherwise be necessary. Finally, the cost of installation in terms of labor necessarily should be minimized, a difficult objective when the installer is required to store, select and manipulate a two or three component roof bolt assembly.

OBJECTS AND SUMMARY OF THE INVENTION

It is therefore a primary object of the present invention to provide a roof bolt assembly which combines into a unitary structure an adhesive-containing sack means and a roof bolt which is to be adhesively mounted within the bore hole drilled in a subterranian roof.

Another object of the present invention is to provide a unitary roof bolt assembly which is compact, easy to handle and store, and which may be simply and easily installed in a minimum amount of time by a single laborer.

An additional object of the present invention is to provide a unitary roof bolt assembly which obviates the need for matching the size of the roof bolt, bore hole, and adhesive-containing cartridge size.

A still further object of the present invention is to provide a roof bolt assembly which, due to its unitary structure, automatically provides the correct amount of adhesive for a particular bore hole upon the selection of the proper sized bolt.

An additional object of the present invention is to provide a unitary roof bolt assembly for strengthening roofs in a subterranian excavation such as a coal mine, subway tunnel, or the like, which may be readily manufactured using available components and which provides ease of use and installation heretofore unobtainable.

The foregoing and other objects are attained in accordance with one aspect of the present invention through the provision of a unitary roof bolt assembly mountable within a bore hole of an excavation roof which is desired to be strengthened. The unitary roof bolt has an elongate stem which is inserted into the bore hole and which is encompassed by a rupturable sack that contains a curable adhesive for fixedly securing the elongate stem within the bore hole. The rupturable sack preferably encompasses the entire length of the elongate stem of the bolt, terminating in a reduced diameter extended portion which is initially ruptured upon contact with the innermost wall of the bore hole. Means are provided for securing the rupturable sack to the elongated stem so as to provide a unitary assembly for ease of storage, handling and installation. The length of the elongate stem is somewhat but not substantially less than the depth of the bore hole to provide a natural rupture means when the bolt is inserted into the hole, the stem preferably including a roughened surface formed along its length for assisting in the rupturing, mixing and bonding of the adhesive when the bolt is rotated.

In accordance with other aspects of the present invention, the adhesive-containing sack preferably comprises a long thin tubular bag or sack which is closely wound in a spiral fashion about the stem so as to substantially cover the entire length thereof. The diameter of the tubular bag or sack is on the order of the diameter of the elongate stem of the bolt. The tubular bag or sack is wound from the head of the bolt, adjacent a standard bearing plate, along the length of the stem to the distal end thereof, from which is extended a reduced diameter spiral wound portion for initial rupture when contacted by the innermost face of the bore hole. The volume of adhesive contained within the tubular sack is selected for the particular bolt size so as to fill the bore hole upon rupture of the sack to therefore secure the bolt in place.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF A PREFERRED EMBODIMENT

Figure 1:
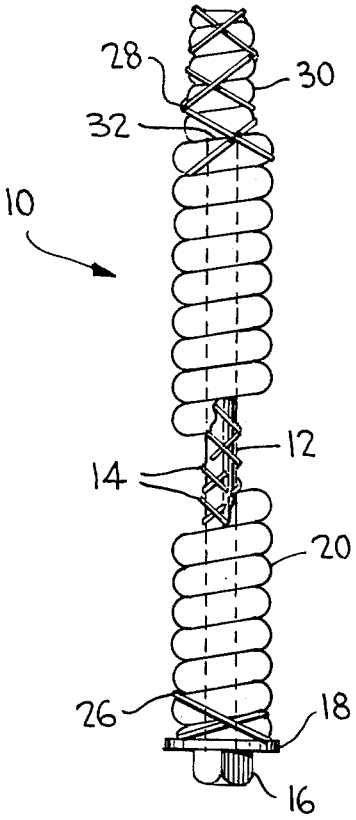
FIG. 1 is a plan view, partially cut away to show structural detail, of a preferred embodiment of the unitary roof bolt assembly according to the present invention.

Referring now to FIG. 1, a preferred embodiment of the unitary rock bolt assembly is indicated generally by the reference numeral 10. Roof bolt 10 comprises an elongate core member or stem 12 which may be comprised of a bolt, bar or rod conventionally utilized. The stem 12 is preferably comprised of a steel reinforcing bar and preferably has formed along the length thereof a roughened surface, which may be embodied by cross-hatched metal ridges 14, for example.

Figure 3:
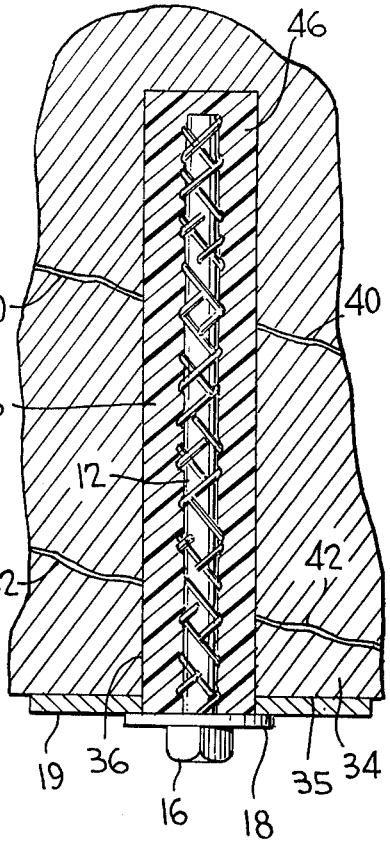
FIG. 3 is a view on the scale of and similar to FIG. 2, which however illustrates the final position and installation of the preferred embodiment unitary roof bolt assembly according to the present invention.

Core member or stem 12 terminates at one end in a standard drive head or nut 16. Positioned adjacent drive head 16 is an enlarged washer 18. A flat metal bearing plate 19 is shown in FIG. 3 engaging the rock face or roof 35, which may be a nominal 6 inches × 6 inches plate being presently required by the Bureau of Mines. The washer and plate 18, 19 serve to support the rock face and seal the outer opening of the hole, as will be explained below. Washer 18 and plate 19 may be preassembled on bolt 10. Alternatively, washer 18 and bearing plate 19 may be assembled on the bolt 10 prior to its insertion in the bore hole by manufacturing bolt 10 with a large flanged head and the washer and plate with apertures large enough to allow them to slide over the bolt 10 and still be caught by the head of the bolt. As another alternative to the foregoing, a nut may be utilized to attach plate 19 after bolt 10 is installed in the bore hole, all of which is conventional. The washer 18 may, of course, be omitted if desired.

The unitary roof bolt 10 of the present invention includes, in the preferred embodiment depicted in FIG. 1, a long, thin, flexible bag or sack 20 which is spirally wound about the stem 12 of the bolt. Preferably, the spiral is closely packed such that adjacent turns of sack 20 contact one another so as to substantially cover and therefore encompass the entire length of stem 12.

In accordance with the preferred embodiment, sack 20 extends along the length of stem 12 from bearing plate 19 to the distal end 32 of core member or stem 12. Furthermore, tubular sack 20 preferably extends beyond distal end 32 of stem 12 in a reduced spiral portion 30. The extended portion 30 of the spiral bag or sack is provided for a purpose which will become clearer hereinafter.

Means are provided for securing the ends of the tubular sack 20 and portion 30 to stem 12 which may comprise, for example, metallic or elastic bands 26 and 28. Band 26 is utilized to secure sack 20 to the head end of bolt 10, adjacent bearing plate 19, while band 28 is wrapped about the reduced diameter portion 30 for retaining the spiral formation adjacent the distal end 32 of stem 12.

Figure 4:
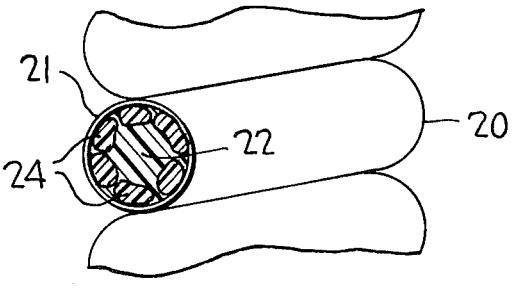
FIG. 4 illustrates in cross-secton the constituents of a preferred embodiment tubular adhesive-containing bag or sack in accordance with the teachings of the present invention.

Referring momentarily to FIG. 4, a cross-section of tubular sack or bag 20 is illustrated. Sack 20 preferably comprises a thin, rupturable wall member 21 which encases a main body of rein material 22 and segregated supplemental bodies of a catalyst, curing or hardening resin 24. The hardening agent 24 is utilized for polymerizing, curing and setting the main body of resin material 22 when they are mixed together and displaced along the bore hole in a manner to be described in more detail below.

Figure 2:
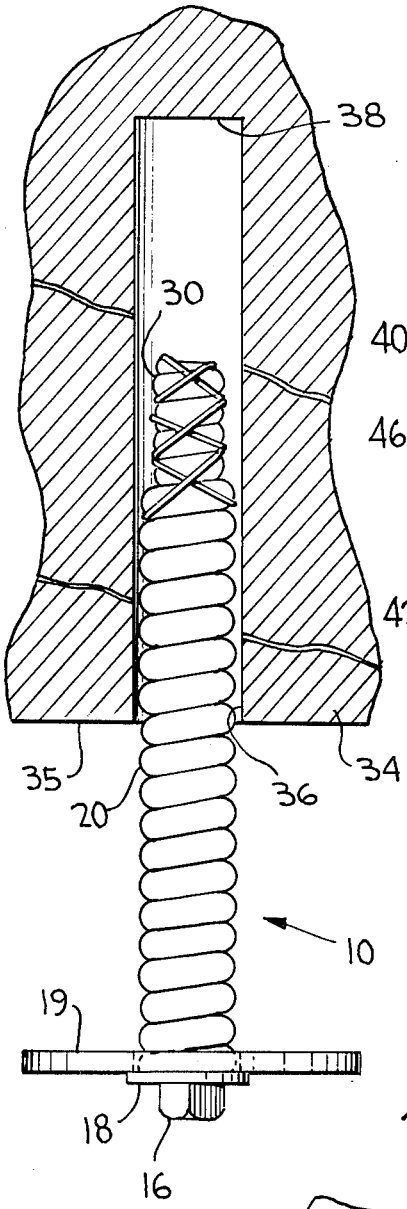
FIG. 2 illstrates a vertical section of a bore hole and shows the initial step in the utilization of the preferred embodiment of the present invention.

Referring now to FIG. 2, the unitary roof bolt 10 of the present invention is illustrated in its initial entry position. A rock-like wall or support structure 34 is to be secured together or reinforced and is provided with a bore or drill hole 36 for receiving the unitary roof bolt assembly 10 of the present invention. The overall diameter of drill bore 36 is just sufficient to accommodate the outer diameter of roof bolt 10 having tubular sack 20 wrapped thereabout. It may be seen from FIG. 2 that the reduced diameter spiral portion 30 extending from the distal end 32 of bolt 10 makes first contact with the innermost end face 38 of bore 36 so as to rupture the sack 20 upon further insertion of bolt 10.

Referring now to FIG. 3, the overall length of stem 12 of the bolt is preferably somewhat but not substantially less than the depth of bore hole 36, such that the full insertion of stem 12 within bore 36 will provide a substantial bursting force for sack 20 and portion 30 by virtue of the pressure exerted by wall 38.

Once the unitary bolt assembly 10 slides fully within bore hole 36, and the plate 18 is firmly seated on roof 35 by means of bolt head 16, the entire assembly 10 is rotated sufficiently to admix the adhesive resin 22 with its catalyst or curing agent 24. The ridges 14 serve to enhance the mixing process as they rub against sack 20, bursting the outer surface and then engaging the hardening agent and resin 24, 22. The mixture, preferably quicksetting, is then allowed to harden in order to tension bolt 10, if desired.

The volume of resin and hardener contained within sack 20 and portion 30 is selected in conjunction with the length and diameter of stem 12 and in order to completely fill bore hole 36 with only a slight excess of volume. This slight excess preferably finds its way into any faults, such as indicated by reference numerals 40 and 42, which may traverse the roof structure at the point of interest, thereby providing, when adhesively compressed, further tensioning and strengthening thereof.

It should be apparent from the foregoing that I have provided a unique unitary roof bolt assembly which is compact, easy to handle and store, and obviates the prior art necessity for matching the bolt and resin bag sizes at the job site. Once the proper sized bolt is selected for the particular hole, its secured resin bag will automatically provide the correct amount of adhesive. The assembly of the present invention may be manufactured in a variety of lengths and diameters to suit any application. The particular resins and hardening agents are a matter of choice and, being conventional, need not be described in detail.

Spiral-wound tubular sack 20 may be either formed of a single contiguous sack or, alternatively, may be formed separately. It should also be apparent that the spiral sack or bag does not necessarily have to be closely packed along the entire length of stem 12, since certain applications may dictate other configurations. Further, while a spiral-wound sack is illustrated as the preferred embodiment, other configurations of unitary assemblies encompassing the core member 12 within the scope of the present invention will suggest themselves to a person skilled in the art.

I therefore wish it to be understood that I do not desire to be limited to the exact details of construction shown and described, since obvious modifications will suggest themselves to a person skilled in the art.

I claim as my invention:

1. A unitary roof bolt assembly mountable within a bore hole of predetermined depth in an excavation roof desired to be strengthened comprising:

a bolt having an elongated stem, a head integral with said stem at one end thereof; and said stem having a distal end opposite said head and a length which is somewhat but not substantially less than the depth of said bore hole which reaches to an innermost wall thereof, a rupturable flexible sack means having a first generally uniformly disposed unbroken portion encompassing said stem in extending from said head to said distal end, and which continues to a relatively narrower generally uniformly disposed unbroken portion covering said distal end and extending therebeyond, said sack means containing a curable adhesive along said extents of said first and said second portions thereof, and being secured to said stem by means wrapped about said first and said second portions until ruptured, whereby an insertion of said bolt within said bore hole which pressure contacts said second portion of said sack means against said innermost bore hole wall provides a substantial force rupturing said sack means so as to fixedly secure said bolt within said bore hole with said adhesive thus released therebetween.

2. The roof bolt assembly of claim 1 wherein said sack means is tubular and is spirally wound about said stem.

3. The roof bolt assembly of claim 2 wherein said first portion of said spirally wound tubular sack is of a first diameter enclosing said stem and said second portion of said sack is of a lesser diameter and spirally extending and covering said distal end of said stem.

4. The roof bolt assembly as set forth in claim 1 wherein said curable adhesive comprises a quick setting adhesive resin and catalyst-hardener resin materials which coact upon said rupture of said sack.

5. The roof bolt assembly as set forth in claim 1 further including bearing plate means positioned between said head and said excavation roof and said plate having a diameter larger than that of said bore hole for supporting said roof and maintaining said curable adhesive within said bore hole about said stem upon said rupture of said sack means.

6. The roof bolt assembly as set forth in claim 1 wherein said stem includes a roughened surface formed along the length thereof.

7. The roof bolt assembly as set forth in claim 1 wherein said means wrapped about said first and second portions securing said sack to said stem comprises a band means.

* * * * *

UNITED STATES PATENT AND TRADEMARK OFFICE

CERTIFICATE OF CORRECTION

PATENT NO. : 4,051,681

DATED : October 4, 1977

INVENTOR(S) : Lee William Yaros

It is certified that error appears in the above-identified patent and that said Letters Patent are hereby corrected as shown below:

On the title Page:

In line of item [76], "[76]" should be --[75]--, and in a line following the item, insert:

[73] Assignee: The United States of America, as represented by the Secretary of the Interior, Washington, D. C.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*